US010229550B1

(12) United States Patent
Tudi

(10) Patent No.: US 10,229,550 B1
(45) Date of Patent: Mar. 12, 2019

(54) SCHEDULED ENABLED LOCKBOX ACCESS

(71) Applicant: Carrier Corporation, Jupier, FL (US)

(72) Inventor: Sandeep Reddy Tudi, Hyderabad (IN)

(73) Assignee: CARRIER CORPORATION, Jupiter, FL (US)

( * ) Notice: Subject to any disclaimer, the term of this patent is extended or adjusted under 35 U.S.C. 154(b) by 0 days.

(21) Appl. No.: 15/855,467

(22) Filed: Dec. 27, 2017

(51) Int. Cl.
*G07C 9/00* (2006.01)

(52) U.S. Cl.
CPC ..... *G07C 9/00309* (2013.01); *G07C 9/00896* (2013.01); *G07C 2009/00769* (2013.01); *G07C 2209/08* (2013.01)

(58) Field of Classification Search
CPC ..... G07C 9/00309; G07C 9/00896; G07C 2209/08; G07C 2009/00769
See application file for complete search history.

(56) References Cited

U.S. PATENT DOCUMENTS 5,245,652 A * 9/1993 Larson ..... G07C 1/32 235/382.5
6,825,753 B2 * 11/2004 Cardinale ..... E05B 43/005 340/5.73
6,937,140 B1 8/2005 Outslay et al.
8,138,886 B1 * 3/2012 Chang ..... E05B 19/0005 340/5.22
8,437,740 B2 5/2013 Despain
8,756,431 B1 * 6/2014 Despain ..... G06F 21/35 713/155
8,786,400 B2 7/2014 Harkins
9,478,083 B2 10/2016 Fisher
9,644,399 B2 5/2017 Johnson
9,670,694 B2 6/2017 Larson
9,704,319 B2 7/2017 Desinor, Jr.
9,852,487 B1 * 12/2017 Farnsworth ..... G06Q 50/16
2003/0179075 A1 * 9/2003 Greenman ..... E05B 19/0005 340/5.54
2005/0001028 A1 * 1/2005 Zuili ..... G06Q 20/341 235/382
2007/0197261 A1 * 8/2007 Humbel ..... G06Q 30/00 455/558
2009/0153291 A1 6/2009 Larson
(Continued)

OTHER PUBLICATIONS http://www.opp.today/worlds-first-smart-lockbox-that-works-offline-across-countries/; igloohome; Jan. 10, 2017; 5 pages.*
(Continued)

*Primary Examiner* — Brian E Miller
(74) *Attorney, Agent, or Firm* — Cantor Colburn LLP

(57) ABSTRACT

A lockbox is provided. The lockbox includes a compartment that has a door and a door locking mechanism controlling operations of the door. The lockbox includes a memory storing a time access period. The lockbox includes a transceiver that automatically activates and manages a wireless communication mechanism based on the time access period. The transceiver also detects a user device on the wireless communication mechanism. The lockbox includes a processor, which is electrically coupled to the memory and the transceiver. The processor automatically authenticates the user device detected on the wireless communication mechanism and disables the door locking mechanism to provide access via the door to the compartment in response to a completed authentication.

16 Claims, 3 Drawing Sheets

(56) References Cited

U.S. PATENT DOCUMENTS

| | | | | |
|---|---|---|---|---|
| 2010/0176919 | A1 | 7/2010 | Vertner | |
| 2011/0053557 | A1* | 3/2011 | Despain | A47G 29/10 455/410 |
| 2011/0138077 | A1* | 6/2011 | Rafat | H03M 9/00 709/247 |
| 2012/0068817 | A1* | 3/2012 | Fisher | G07C 9/00571 340/5.61 |
| 2013/0187756 | A1* | 7/2013 | Fisher | G07C 9/00571 340/5.61 |
| 2015/0356695 | A1* | 12/2015 | Schmidt-Lackner | G06Q 50/163 705/30 |
| 2016/0098878 | A1 | 4/2016 | Cabouli | |
| 2016/0180621 | A1* | 6/2016 | Desinor, Jr. | G07C 9/00896 340/5.61 |
| 2016/0321847 | A1* | 11/2016 | Briskey | G07C 9/00087 |
| 2016/0364929 | A1* | 12/2016 | Fisher | G07C 9/00174 |
| 2017/0161979 | A1* | 6/2017 | Schmidt-Lackner | G07C 9/00571 |
| 2018/0075676 | A1* | 3/2018 | Briskey | G07C 9/00087 |

OTHER PUBLICATIONS

Andrew J. Hawkins, Toyota Invented a Box that Turns Your Smartphone into a Car Key, Oct. 31, 2016, https://www.theverge.com/2016/10/31/13460722/toyota-car-share-smart-key-box-getaround.

Andy Boxall, Keep Spare Keys Really Safe Inside This Bluetooth-Connected Key Box, Jul. 5, 2017, https://www.digitaltrends.com/mobile/master-lock-5441-bluetooth-key-box-news/.

Youtube, Digital Car Key: Vehicle Access with Cellular Phone and Bluetooth, Aug. 31, 2016, https://www.youtube.com/watch?v=vdnrr5i4naE.

* cited by examiner

SCHEDULED ENABLED LOCKBOX ACCESS

CROSS-REFERENCE TO RELATED APPLICATIONS

This application claims the benefit of Indian Patent Application Number 201711036413, filed Oct. 13, 2017, which is incorporated herein by reference in its entirety.

BACKGROUND

Typical key boxes require real estate agents to physically push a key container on the key box to enable a Bluetooth feature for authentication with an agent's smart phone. Once the authentication is complete, the typical key boxes require the real estate agents to again push the key container to access keys stored therein. These multiple interactions with the typical key boxes are time consuming for clients and the real estate agents.

BRIEF DESCRIPTION

In accordance with one or more embodiments, a lockbox is provided. The lockbox comprises a compartment comprising a door and a door locking mechanism controlling operations of the door; a memory storing a time access period; a transceiver automatically activating and managing a wireless communication mechanism based on the time access period and detecting a user device on the wireless communication mechanism; and a processor, electrically coupled to the memory and the transceiver, automatically authenticating the user device detected on the wireless communication mechanism and disabling the door locking mechanism to provide access via the door to the compartment in response to a completed authentication.

In accordance with one or more embodiments or the lockbox embodiment above, the transceiver can automatically deactivate the wireless communication mechanism based on an expiration of the time access period.

In accordance with one or more embodiments or any of the lockbox embodiments above, the first transceiver can receive the user pin from the user device; and the authenticating of the user device can comprise the first processor authenticating the user device when the user pin matches an authentication pin associated with the time access period.

In accordance with one or more embodiments or any of the lockbox embodiments above, the time access period can comprise a predefined time range for providing user access to the compartment.

In accordance with one or more embodiments or any of the lockbox embodiments above, the memory can store an access schedule defining a plurality of access periods, including the time access period, and the transceiver can automatically activate and deactivate the wireless communication mechanism based on each access period of the access schedule.

In accordance with one or more embodiments or any of the lockbox embodiments above, the wireless communication mechanism can comprise a personal area network operating on short wavelength radio waves in accordance with a wireless technology standard.

In accordance with one or more embodiments or any of the lockbox embodiments above, the wireless technology standard can comprise Bluetooth.

In accordance with one or more embodiments or any of the lockbox embodiments above, the lockbox can comprise an interface button that bypasses the automatic authentication of the user device and triggers a direct pairing of the lockbox and the user device when pressed.

In accordance with one or more embodiments or any of the lockbox embodiments above, the lockbox can comprise an interface button that opens the door to the compartment when pressed after the completed authentication and the disabling of the door locking mechanism.

In accordance with one or more embodiments or any of the lockbox embodiments above, the lockbox can comprise a real estate electronic padlock-shaped box that stores one or more keys in the compartment.

In accordance with one or more embodiments, a lockbox system is provided. The lockbox system comprises an electronic lockbox. The electronic lockbox comprises a compartment comprising a door and a door locking mechanism controlling operations of the door, a first memory storing a time access period, a first transceiver automatically activating and managing a wireless communication mechanism based on the time access period and detecting a user device on, and a first processor, electrically coupled to the first memory and the first transceiver, automatically authenticating the user device detected on the wireless communication mechanism and disabling the door locking mechanism to provide access via the door to the compartment in response to a completed authentication. The lockbox system comprises the wireless communication mechanism supporting communications between the electronic lockbox and the user device. The lockbox system comprises the user device. The user device comprising a second memory storing an application; a second transceiver automatically detecting the wireless communication mechanism; and a processor, electrically coupled to the second memory and the second transceiver, automatically providing a user pin to the electronic lockbox.

In accordance with one or more embodiments or the lockbox system embodiment above, the first transceiver can automatically deactivate the wireless communication mechanism based on an expiration of the time access period.

In accordance with one or more embodiments or any of the lockbox system embodiments above, the first transceiver can receive the user pin from the user device; and the authenticating of the user device can comprise the first processor authenticating the user device when the user pin matches an authentication pin associated with the time access period.

In accordance with one or more embodiments or any of the lockbox system embodiments above, the time access period can comprise a predefined time range for providing user access to the compartment.

In accordance with one or more embodiments or any of the lockbox system embodiments above, the memory can store an access schedule defining a plurality of access periods, including the time access period, and the first transceiver can automatically activate and deactivate the wireless communication mechanism based on each access period of the access schedule.

In accordance with one or more embodiments or any of the lockbox system embodiments above, the wireless communication mechanism can comprise a personal area network operating on short wavelength radio waves in accordance with a wireless technology standard.

In accordance with one or more embodiments or any of the lockbox system embodiments above, the wireless technology standard can comprise Bluetooth.

In accordance with one or more embodiments or any of the lockbox system embodiments above, the electronic lockbox can comprise an interface button that bypasses the automatic authentication of the user device and triggers a direct pairing of the electronic lockbox and the user device when pressed.

In accordance with one or more embodiments or any of the lockbox system embodiments above, the electronic lockbox can comprise an interface button that opens the door to the compartment when pressed after the completed authentication and the disabling of the door locking mechanism.

In accordance with one or more embodiments or any of the lockbox system embodiments above, the electronic lockbox can comprise a real estate electronic padlock-shaped box that stores one or more keys in the compartment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
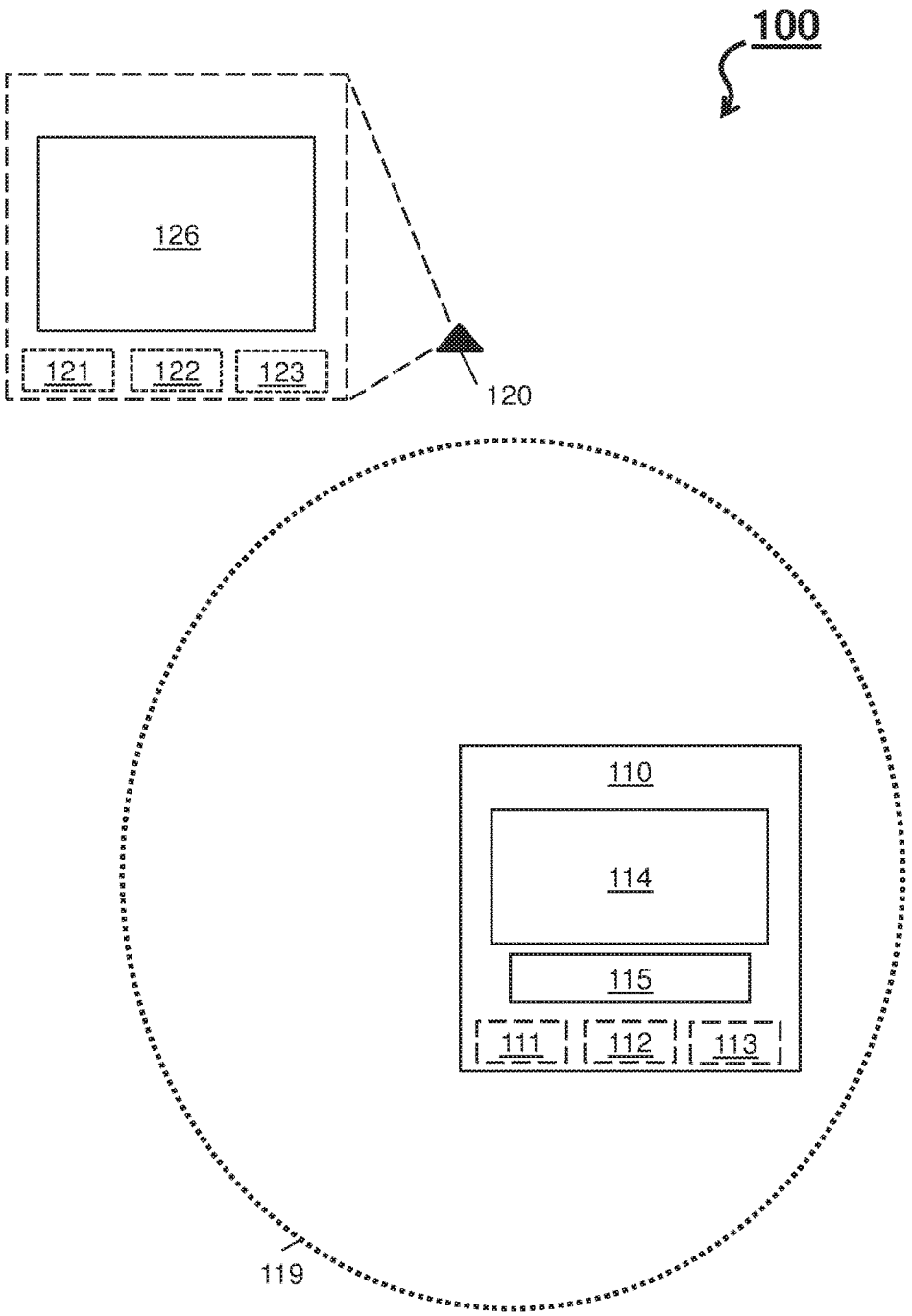
FIG. 1 depicts a lockbox system according to one or more embodiments.

FIG. 1 depicts a lockbox system 100 according to one or more embodiments. As shown in FIG. 1, the lockbox system 100 can include an electronic lockbox 110 comprising a processor 111, a memory 112, a transceiver 113, a compartment 114, and an interface button 115. The lockbox system 100 can further comprise a wireless communication mechanism 119 and a user device 120. The user device 120 comprise a processor 121, a memory 122, a transceiver 123, and a display 126. The lockbox system 100 is an example and is not intended to suggest any limitation as to the scope of use or operability of embodiments described herein (indeed additional or alternative components and/or implementations may be used). Further, while single items are illustrated for items of the lockbox system 100, these representations are not intended to be limiting and thus, any item may represent a plurality of items.

The electronic lockbox 110 can be any device or system that holds keys to a property (or other item) in the compartment 114 to allow communal access for all users or real estate agents to keep the keys secure (e.g., a real estate electronic padlock-shaped box that hangs around a doorknob of a house). In accordance with one or more embodiments, the electronic lockbox 110 can be a type of electronic lock associated with a property that can be automatically and wireless actuated without requiring a separate physical or traditional mechanical lock and key. The electronic lockbox 110 can also be a device or system, e.g., a vending machine, heating ventilating air-conditioning equipment, a cellular communications tower and equipment structure, as non-limiting examples. The electronic lockbox 110 can include a battery that powers the components therein.

The compartment 114 of the electronic lockbox 110 can be a chamber that stores and holds keys or other items. The compartment 114 can include a door and a door locking mechanism controlling operations of the door.

The interface button 115 can be an electro-mechanical interface or button that controls/operates the door of the compartment 114 so a user can access keys stored within. In accordance with one or more embodiments, the pressing of the interface button 115 can disable or enable the door locking mechanism only after the electronic lockbox 110 authorizes a user (e.g., authorizes a user device 120). For instance, interface button 115 opens the door to the compartment 114 when pressed after an automatic completion of an authentication and an automatic of a disabling of the door locking mechanism. The interface button 115 can also control/operate the transceiver 113 to provide and manage the wireless communication mechanism 119 (so the user device 120 can communicate with the electronic lockbox 110). In accordance with one or more embodiments, the pressing of the interface button 115 can bypass an automatic authentication of the user device and trigger a direct pairing of the electronic lockbox 110 and the user device 120.

The wireless communication mechanism 119 can be any communication structure that wirelessly supports communications between the electronic lockbox 110 and the user device 120. In this regard, the wireless communication mechanism 119 can comprise one or more networks, such as a personal area network (PAN), a local area network (LAN), a general wide area network (WAN), and/or a public network (e.g., the Internet). In accordance with one or more embodiments, the wireless communication mechanism 119 comprises a PAN operating on short wavelength radio waves in accordance with a wireless technology standard, such as Bluetooth.

In accordance with one or more embodiments, the wireless communication mechanism 119 can be automatically disabled or enabled by the processor 111 in accordance with one or more time access periods stored in the memory 112. Each of the one or more time access periods can be a predefined time range for providing user access to the compartment 114, such as access by a real estate agent. Further, by way of example, the one or more time access periods can be provided by a user device of a seller's real estate agent to the electronic lockbox 110 in advance of a buyer's real estate agent showing a property. Examples of the predefined time range include, but are not limited to, a time period ranging from a first time to a second time (e.g., where the wireless communication mechanism 119 is active for the entire time period).

In accordance with one or more embodiments, the memory 112 can store an access schedule defining a plurality of access periods, e.g., the one or more time access periods. For instance, by way of example, the access schedule can be uploaded from the user device of the seller's real estate agent that is connected to the electronic lockbox 110 in advance of the buyer's real estate agent showing the property.

Each of the one or more time access periods can correspond to an authentication pin. An authentication pin is a unique alphanumeric identification number used to distinguish who is authorized to access the property during a corresponding time access period. Because the wireless communication mechanism 119 is automatically activated according to the time access periods, the authentication pin can ensure that only the intended user accesses the electronic lockbox 110 and the property.

The user device 120 can be any electronic device comprising computer hardware and/or software that enables a user to interact with the electronic lockbox 110. The user device 120 can move with respect to the wireless communication mechanism 119, e.g., move in and out of communication range of the electronic lockbox 110. Examples of the user device 120 include, but are not limited to, cell phones, smart phones, tablet computers, personal digital assistants, laptops, and mobile computing devices. The display 126 of the user device 120 can be electronic device for a visual presentation of a user interface and/or data. The display 126 can also include an input mechanism for receiving instructions or pins from the user. Examples of the display 124 include, but are not limited to, a digital touch screen.

The processors 111 and 121 can include any processing hardware, software, or combination of hardware and software utilized by the electronic lockbox 110 and the user device 120 that carries out the computer readable program instructions by performing arithmetical, logical, and/or input/output operations. Examples of the processors 111 and 121 include, but are not limited to an arithmetic logic unit, which performs arithmetic and logical operations; a control unit, which extracts, decodes, and executes instructions from a memory; and/or an array unit, which utilizes multiple parallel computing elements.

The memories 112 and 122 can include a tangible device that retains and stores computer readable program instructions (e.g., a mobile application and/or one or more time access periods), as provided by the electronic lockbox 110 and the user device 120, for use by the processors 111 and 121. For example, the memories 112 and 122 can include computer system readable media in the form of volatile memory, such as random access memory and cache memory, and/or non-volatile memory, such as read only memory and a hard disk. The computer readable program instructions can include software or program by way of example, and not limitation, as well as an operating system, one or more application programs or mobile applications, other program modules, and program data. Each of the operating system, the one or more application programs or mobile applications, the other program modules, and the program data or some combination thereof, may include an implementation of the process flows described herein to improve the operations of the processors 111 and 121, the memories 112 and 122, the electronic lockbox 110, and the user device 120 to achieve benefits over the typical key boxes described herein.

The transceivers 113 and 123 can include a physical and/or virtual mechanism utilized by the electronic lockbox 110 and the user device 120 to communicate between elements internal and/or external to the electronic lockbox 110 and the user device 120. For example, the transceiver 113 of the electronic lockbox 110 may communicate with the user device 120 via the wireless communication mechanism 119. Further, the transceiver 123 of the user device 120 may communicate with the electronic lockbox 110 via the wireless communication mechanism 119. In this way, the transceivers 113 and 123 can utilize power of the battery of the electronic lockbox to provide the wireless communication mechanism 119.

In general, the lockbox system 100 utilizes the electronic lockbox 110 to automatically activate and manage the wireless communication mechanism 119 according to one or more time access periods. In this regard, the electronic lockbox 110 can utilize the configuration described herein or include additional computer hardware and/or software to automatically activate and manage the wireless communication mechanism 119 and to communicate with other systems and sub-systems through any network communication technologies.

In accordance with one or more embodiments, since the wireless communication mechanism 119 can be automatically enabled on the electronic lockbox 110 during the one or more time access periods, a user can enter a user pin on a mobile application of the user device 120, when the user device 120 is in the range of the wireless communication mechanism 119 but not yet at the electronic lockbox 110. In turn, by the time user arrives at the electronic lockbox 110, an authorization transaction of the user device 120 by the electronic lockbox 110 is completed and the keys can be made available (e.g., these operations can be completed from when a real estate agent leaves their car and before arrival at the electronic lockbox 110).

Thus, the automatic activation and management of the wireless communication mechanism 119 is necessarily rooted in operations of the electronic lockbox 110 to overcome problems arising with respect to the typical key boxes described herein. For instance, the lockbox system 100 provides the technical effects and benefits of reducing a number of key container pushes required by the typical key boxes, thereby saving the clients and the real estate agents time and providing a flawless building access experience to the clients. Further, the lockbox system 100 provides the technical effects and benefits of reducing an amount of usage of the battery of the electronic lockbox 110 (e.g., extends battery life) by the automatic activation and management of the wireless communication mechanism 119 compared to always leaving the wireless communication mechanism 119 active.

Figure 2:
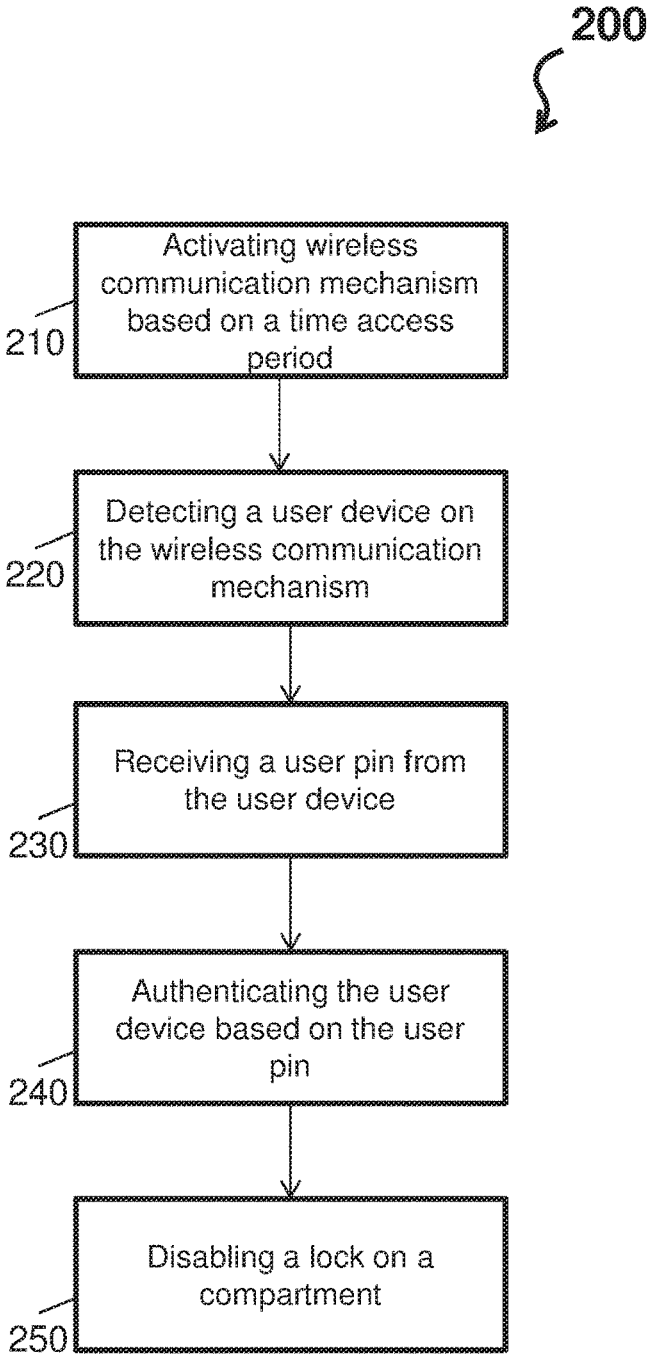
FIG. 2 depicts a process flow of a lockbox system according to one or more embodiments.

Turning now to FIG. 2, a process flow 200 of the lockbox system 100 is depicted according to one or more embodiments. The process flow 200 is an example of the operations of the electronic lockbox 110 to overcome problems arising with respect to the typical key boxes. The process flow 200 begins at block 210, where the electronic lockbox 110 activates the wireless communication mechanism 119 based on a time access period. The time access period can be associated with an authentication pin stored in the memory 112. In accordance with one or more embodiments, the memory 112 can store an access schedule defining a plurality of access periods, including the time access period. The transceiver 113 of the electronic lockbox 110 can, in turn, automatically activate and manage the wireless communication mechanism 119 based on the time access period, each access period of the access schedule, and/or the access schedule.

At block 220, the transceiver 113 of the electronic lockbox 110 detects the user device 120 on the wireless communication mechanism 119 (e.g., when a seller's real estate agent reaches the property along with a client). At block 230, the transceiver 113 of the electronic lockbox 110 receives the user pin from the user device. The user pin is passed by the transceiver 113 to the processor 111 for authentication. At block 240, the processor 111 of the electronic lockbox 110 authenticates the user device 120 based on the user pin. In accordance with one or more embodiments, the processor 111 automatically authenticating the user device 120, upon detection on the wireless communication mechanism, by matching the user pin with the authentication pin associated with the time access period. If the user pin and the authentication pin match, the authentication transaction completes.

At block 250, the electronic lockbox 110 disables a lock on a compartment (e.g., automatically disables the door locking mechanism to provide access via the door to the compartment 114 in response to a completed authentication in block 240). At this stage, the user can push the interface button 115 to access the key in the compartment of the electronic lockbox 110 (there is no need for the user to push the interface button 115 more than once).

For instance, after the buyer's real estate agent enters into a range of the wireless communication mechanism 119, a prompt is provided via the display 126 of the user device 120 for the buyer's real estate agent to enter a user pin. The buyer's real estate agent can provide the user pin in via the display 126 to the user device 120 (note that it is likely that the buyer's real estate agent is not physically able to touch the electronic lockbox 110 at this time because they are to distant, at their car). As the buyer's real estate agent approaches the electronic lockbox 110, the user device 120 automatically communicates the user pin to the electronic lockbox 110 and an automatic authentication transaction is completed. The buyer's real estate can now immediately access a key protected by the electronic lockbox 110 upon arrival at the electronic lockbox 110. In contrast, operations of the typical key box require the buyer's real estate agent to physically find and engage the typical key box to directly enable the Bluetooth feature. Then, the buyer's real estate agent waits at the typical key box for an authentication to complete before again engaging the typical key box to access the key (e.g., the buyer's real estate agent has to engage the typical key box twice: once to enable the Bluetooth feature and once to open the typical key box).

Figure 3:
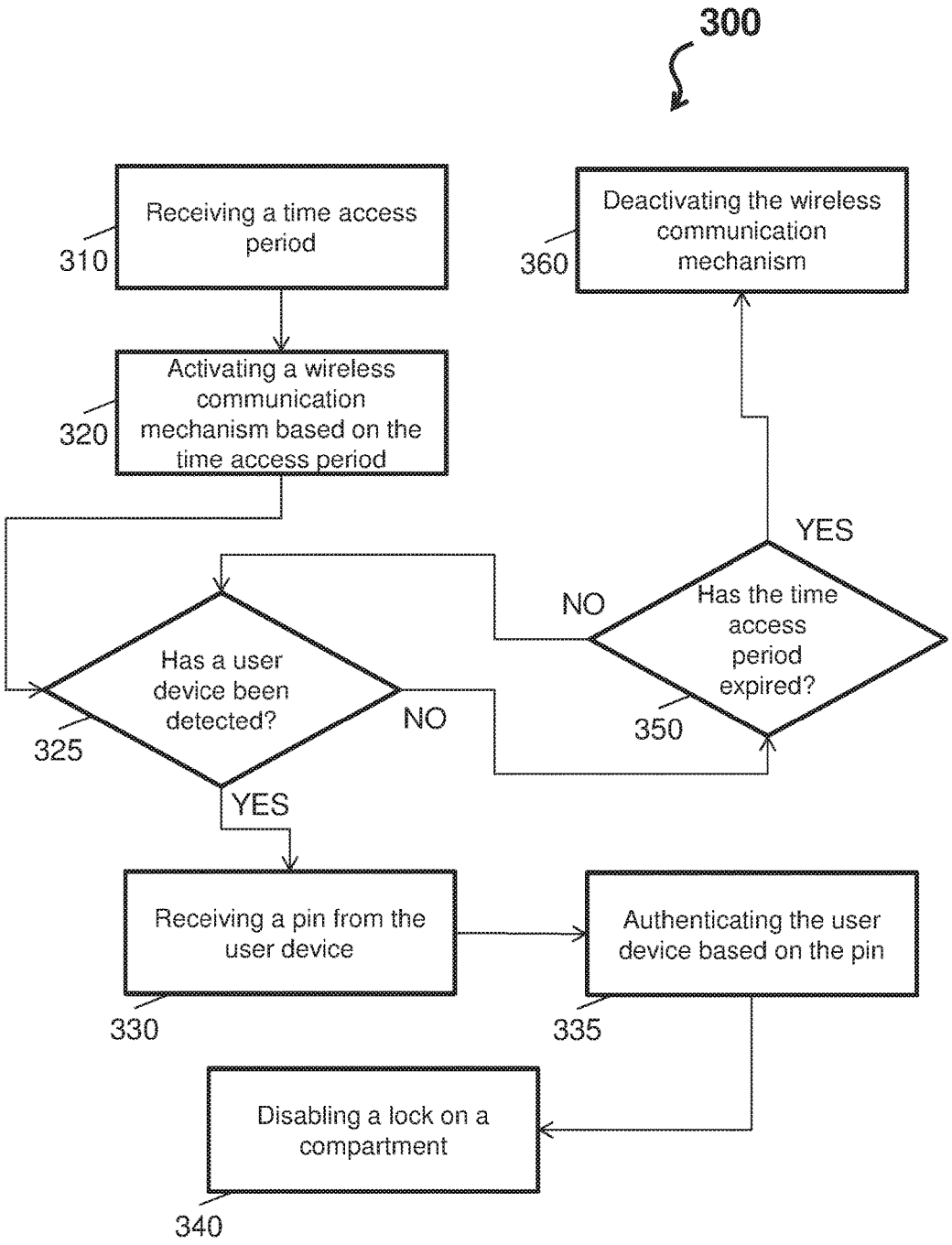
FIG. 3 depicts a process flow of a lockbox system according to one or more embodiments.

Turning now to FIG. 3, a process flow 300 of the lockbox system 100 is depicted according to one or more embodiments. The process flow 300 is an example of the operations of the electronic lockbox 110 to overcome problems arising with respect to the typical key boxes. The process flow 300 begins at block 310, where the electronic lockbox 110 receives a time access period. For instance, by way of example, the time access period can be uploaded from the user device of the seller's real estate agent that is connected to the electronic lockbox 110 in advance of the buyer's real estate agent showing the property.

At block 320, the electronic lockbox 110 activates the wireless communication mechanism 119 based on a time access period. The time access period can be associated with an authentication pin stored in the memory 112. At decision block 325, the transceiver 113 of the electronic lockbox 110 determines whether the user device 120 has been detected on the wireless communication mechanism 119. If the electronic lockbox 110 determines that the user device 120 has been detected on the wireless communication mechanism 119, the process flow proceeds to block 330 (as shown by the YES arrow).

At block 330, the transceiver 113 of the electronic lockbox 110 receives the user pin from the user device. The user pin is passed by the transceiver 113 to the processor 111 for automatic authentication. At block 335, the processor 111 of the electronic lockbox 110 authenticates the user device 120 based on the user pin. At block 340, the electronic lockbox 110 disables a lock on a compartment (e.g., automatically disables the door locking mechanism to provide access via the door to the compartment 114 in response to a completed authentication in block 240).

Returning to decision block 325, if the electronic lockbox 110 determines that the user device 120 has not been detected on the wireless communication mechanism 119, the process flow proceeds to block 350 (as shown by the NO arrow). At decision block 350, the processor 111 of the electronic lockbox 110 determines whether the time access period has expired. If the electronic lockbox 110 determines that the time access period has not expired, the process flow returns to decision block 325 (as shown by the NO arrow). This loop between decision block 325 and 350 can repeat until the user device 120 is detected or the time access period has expired.

Returning to decision block 350, if the electronic lockbox 110 determines that the time access period has expired, the process flow proceeds to block 360 (as shown by the YES arrow). At block 360, the transceiver 113 of the electronic lockbox 110 deactivates the wireless communication mechanism. That is, the transceiver 113 automatically deactivates the wireless communication mechanism based on an expiration of the time access period. The automatic activation and deactivation improve upon the operations of the electronic lockbox 110 by extending a battery life.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A lockbox comprising:

a compartment comprising a door and a door locking mechanism controlling operations of the door;

a memory storing a time access period and an authentication pin associated with the time access period;

a transceiver automatically activating and managing a wireless communication mechanism based on the time access period and detecting a user device on the wireless communication mechanism, the transceiver automatically deactivating the wireless communication mechanism based on an expiration of the time access period, the transceiver receiving a user pin from the user device; and a processor, electrically coupled to the memory and the transceiver, automatically authenticating the user device detected on the wireless communication mechanism when the user pin matches the authentication pin associated with the time access period and providing the expiration of the time access period has not occurred, the processor disabling the door locking mechanism to provide access via the door to the compartment in response to a completed authentication.

2. The lockbox of claim 1, wherein the time access period comprises a predefined time range for providing user access to the compartment.

3. The lockbox of claim 1, wherein the memory stores an access schedule defining a plurality of access periods, including the time access period, and wherein the transceiver automatically activates and deactivates the wireless communication mechanism based on each access period of the access schedule.

4. The lockbox of claim 1, wherein the wireless communication mechanism comprises a personal area network operating on short wavelength radio waves in accordance with a wireless technology standard.

5. The lockbox of claim 4, wherein the wireless technology standard comprises Bluetooth.

6. The lockbox of claim 1, wherein the lockbox comprises an interface button that bypasses the automatic authentication of the user device and triggers a direct pairing of the lockbox and the user device when pressed.

7. The lockbox of claim 1, wherein the lockbox comprises an interface button that opens the door to the compartment when pressed after the completed authentication and the disabling of the door locking mechanism.

8. The lockbox of claim 1, wherein the lockbox comprises a real estate electronic padlock-shaped box that stores one or more keys in the compartment.

9. A lockbox system comprising:

an electronic lockbox comprising:

a compartment comprising a door and a door locking mechanism controlling operations of the door, a first memory storing a time access period and an authentication pin associated with the time access period, a first transceiver automatically activating and managing a wireless communication mechanism based on the time access period and detecting a user device on, the first transceiver automatically deactivating the wireless communication mechanism based on an expiration of the time access period, the first transceiver receiving a user pin from the user device, and a first processor, electrically coupled to the first memory and the first transceiver, automatically authenticating the user device detected on the wireless communication mechanism when the user pin matches the authentication pin associated with the time access period and providing the expiration of the time access period has not occurred, the processor disabling the door locking mechanism to provide access via the door to the compartment in response to a completed authentication;

the wireless communication mechanism supporting communications between the electronic lockbox and the user device; and the user device comprising:

a second memory storing an application;

a second transceiver automatically detecting the wireless communication mechanism; and a processor, electrically coupled to the second memory and the second transceiver, automatically providing a user pin to the electronic lockbox.

10. The lockbox system of claim 9, wherein the time access period comprises a predefined time range for providing user access to the compartment.

11. The lockbox system of claim 9, wherein the memory stores an access schedule defining a plurality of access periods, including the time access period, and wherein the first transceiver automatically activates and deactivates the wireless communication mechanism based on each access period of the access schedule.

12. The lockbox system of claim 9, wherein the wireless communication mechanism comprises a personal area network operating on short wavelength radio waves in accordance with a wireless technology standard.

13. The lockbox system of claim 12, wherein the wireless technology standard comprises Bluetooth.

14. The lockbox system of claim 9, wherein the electronic lockbox comprises an interface button that bypasses the automatic authentication of the user device and triggers a direct pairing of the electronic lockbox and the user device when pressed.

15. The lockbox system of claim 9, wherein the electronic lockbox comprises an interface button that opens the door to the compartment when pressed after the completed authentication and the disabling of the door locking mechanism.

16. The lockbox system of claim 9, wherein the electronic lockbox comprises a real estate electronic padlock-shaped box that stores one or more keys in the compartment.

* * * * *